US007304431B2

(12) United States Patent
Hasegawa et al.

(10) Patent No.: US 7,304,431 B2
(45) Date of Patent: Dec. 4, 2007

(54) PLASMA DISPLAY PANEL

(75) Inventors: Kazuya Hasegawa, Takatsuki (JP); Hiroyuki Kado, Ibaraki (JP); Yoshiki Sasaki, Shijonawate (JP); Masaki Nishinaka, Mino (JP); Masafumi Okawa, Suita (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 171 days.

(21) Appl. No.: 10/524,616

(22) PCT Filed: May 14, 2004

(86) PCT No.: PCT/JP2004/006881

§ 371 (c)(1),
(2), (4) Date: Feb. 16, 2005

(87) PCT Pub. No.: WO2004/102607

PCT Pub. Date: Nov. 25, 2004

(65) Prior Publication Data

US 2006/0152156 A1 Jul. 13, 2006

(30) Foreign Application Priority Data

May 19, 2003 (JP) ..... 2003-140163
May 19, 2003 (JP) ..... 2003-140164

(51) Int. Cl.
*H01J 61/26* (2006.01)

(52) U.S. Cl. ..... 313/582; 313/562

(58) Field of Classification Search ..... 313/484–487, 313/493, 549, 582–587, 562, 561, 481; 345/37, 345/41; 315/169.4
See application file for complete search history.

(56) References Cited

U.S. PATENT DOCUMENTS 4,306,887 A * 12/1981 Barosi et al. ..... 95/116

(Continued)

FOREIGN PATENT DOCUMENTS

JP 9-11541 5/1997

(Continued)

OTHER PUBLICATIONS

"2001 FPD Technology Outlook", Electronic Journal, Oct. 25, 2000, pp. 615-618.

(Continued)

*Primary Examiner*—Nimeshkumar D. Patel
*Assistant Examiner*—Christopher M. Raabe
(74) *Attorney, Agent, or Firm*—RatnerPrestia

(57) ABSTRACT

A highly reliable plasma display panel which suppresses degradation of phosphor characteristic by removing impurity gases inside the plasma display panel. A front board includes scanning electrodes and maintenance electrodes. A and rear board includes data electrodes; partitions disposed in parallel and an exhaust hole. The scanning electrodes and maintenance electrodes of the front board and the data electrode of rear board cross. A non-evaporating getter such as zeolite is disposed inside plasma display panel near the exhaust hole.

3 Claims, 5 Drawing Sheets

U.S. PATENT DOCUMENTS

| | | | | |
|---|---|---|---|---|
| 5,614,785 | A * | 3/1997 | Wallace et al. | 313/496 |
| 5,945,780 | A * | 8/1999 | Ingle et al. | 313/495 |
| 6,189,579 | B1 * | 2/2001 | Tanaka | 141/8 |
| 6,426,588 | B1 * | 7/2002 | Yanagisawa | 313/422 |
| 6,559,596 | B1 | 5/2003 | Arai et al. | |
| 2002/0008469 | A1 * | 1/2002 | Carretti et al. | 313/562 |
| 2002/0151247 | A1 * | 10/2002 | Yanagisawa | 445/50 |

FOREIGN PATENT DOCUMENTS

| | | | |
|---|---|---|---|
| JP | 10-326572 | | 12/1998 |
| JP | 11-329246 | A | 11/1999 |
| JP | 2000-311588 | A | 11/2000 |
| JP | 2002-358892 | | 12/2002 |
| JP | 2003-281994 | | 10/2003 |

OTHER PUBLICATIONS

International Search Report corresponding to application No. PCT/JP2004/006881 dated Aug. 24, 2004.

* cited by examiner

PLASMA DISPLAY PANEL

This application is a U.S. National Phase Application of PCT International application PCT/JP2004/006881.

TECHNICAL FIELD

The present invention relates to plasma display panels, and more particularly to plasma display panels with stable discharge and stable phosphor characteristics.

BACKGROUND ART

In the field of color display devices for images, such as computers and television sets, plasma display devices employing a plasma display panel (PDP) are being increasingly drawing attention due to their advantages of being large, thin and light.

In a PDP, a front board and a rear board are sealed together with a discharge space of predetermined thickness in between. The electrodes and dielectric layer, or partition and phosphor layer, are formed on the front board and rear board respectively by firing structural materials containing organic binder.

During PDP manufacture, impurity gases spread in the PDP by thermal decomposition, typically of the organic binder contained in the glass frit used as sealing material in the sealing process, in particular, that for sealing the front board and rear board. The constituents of these impurity gases are chiefly water vapor, carbon dioxide and hydrocarbon gases. These gases are adsorbed onto the phosphors inside the PDP and cause problems such as degraded discharge characteristic or reduced luminance. This fact is disclosed, for example, in the Japanese Patent Laid-open Application No. 2003-281994 and FPD Technology Outlook, Electronic Journal, Oct. 25, 2000, pp 615-618.

Accordingly, the reduction of impurity gases inside the PDP to stabilize the discharge characteristic and suppress secular change to improve reliability is an important challenge in PDP manufacture.

For this purpose, a commonly used method is to evacuate the PDP while heating it, after sealing the front and rear boards, so as to remove impurity gases inside the PDP, and then inject the discharge gas. FIG. 6 is a sectional view of this type of conventional PDP manufacturing equipment. PDP 60 is configured with front board 61 and rear board 62; and partition 63 and phosphor layer 64 are formed on rear board 62. The surround of front board 61 and rear board 62 is sealed with sealing material 72. Exhaust pipe 65 is connected to rear board 62 of PDP 60, and PDP 60 is placed in furnace 67 equipped with heater 66. The other end of exhaust pipe 65 branches into two. One is connected to vacuum pump 70 via valve 68, and another is connected to container 71 via valve 69.

In the manufacturing equipment as configured above, the pressure inside PDP 60 is first reduced by opening valve 68 of vacuum pump 70 while heating PDP 60 with heater 66 so that impurity gases are exhausted from inside the PDP. Then, valve 68 is closed and valve 69 is opened to inject discharge gas containing neon and xenon from container 71. Lastly, the exhaust pipe 65 is heated and fused at near the PDP to seal and complete the PDP in which discharge gas is sealed inside.

In addition to exhausting impurity gases from inside PDP 60, the Japanese Laid-open Application No. 2000-311588 discloses the adsorption of impurity gases by providing a getter inside PDP 60. The Japanese laid-open Patent No. H11-329246 also discloses a method of adsorbing impurity gases by providing a getter inside exhaust pipe 65.

However, in the above conventional methods, discharge gas is injected through the exhaust pipe. Since impurity gases exhausted from the PDP are adsorbed onto the inner wall of the exhaust pipe, impurity gases re-enter the PDP together with the discharge gas when feeding in the discharge gas, resulting in their insufficient removal. With the method of adsorbing impurity gases by providing a getter inside the PDP, the getter's effect does not extend over the entire area, since the discharge space is divided by the partitions. Partially remaining impurity gases causes uneven display. Furthermore, the getter, when heated by electric discharge during use, allows impurity gases to be released into the PDP again. With the method of removing impurity gases by providing a getter inside the exhaust pipe, impurity constituents are gradually accumulated on the getter, and thus its capability to remove impurity gases declines over a period.

The present invention aims to solve the above disadvantage, and offers a highly reliable PDP with improved display characteristic and less degraded phosphor by reliably keeping inside the PDP clean so as to suppress erroneous discharge and reduced luminance.

DISCLOSURE OF INVENTION

To counter the above disadvantages, a PDP of the present invention has an exhaust hole for evacuating inside, and a non-evaporating getter is disposed inside the PDP near the exhaust hole.

With this configuration, the non-evaporating getter, a gas adsorption layer, adsorbs impurity gases inside the PDP or those that come in from outside, enabling suppression of phosphor luminance degradation due to impurity gases.

DETAILED DESCRIPTION OF PREFERRED EMBODIMENT(S)

Exemplary embodiments of the present invention are described below with reference to drawings.

First Exemplary Embodiment

Figure 1:
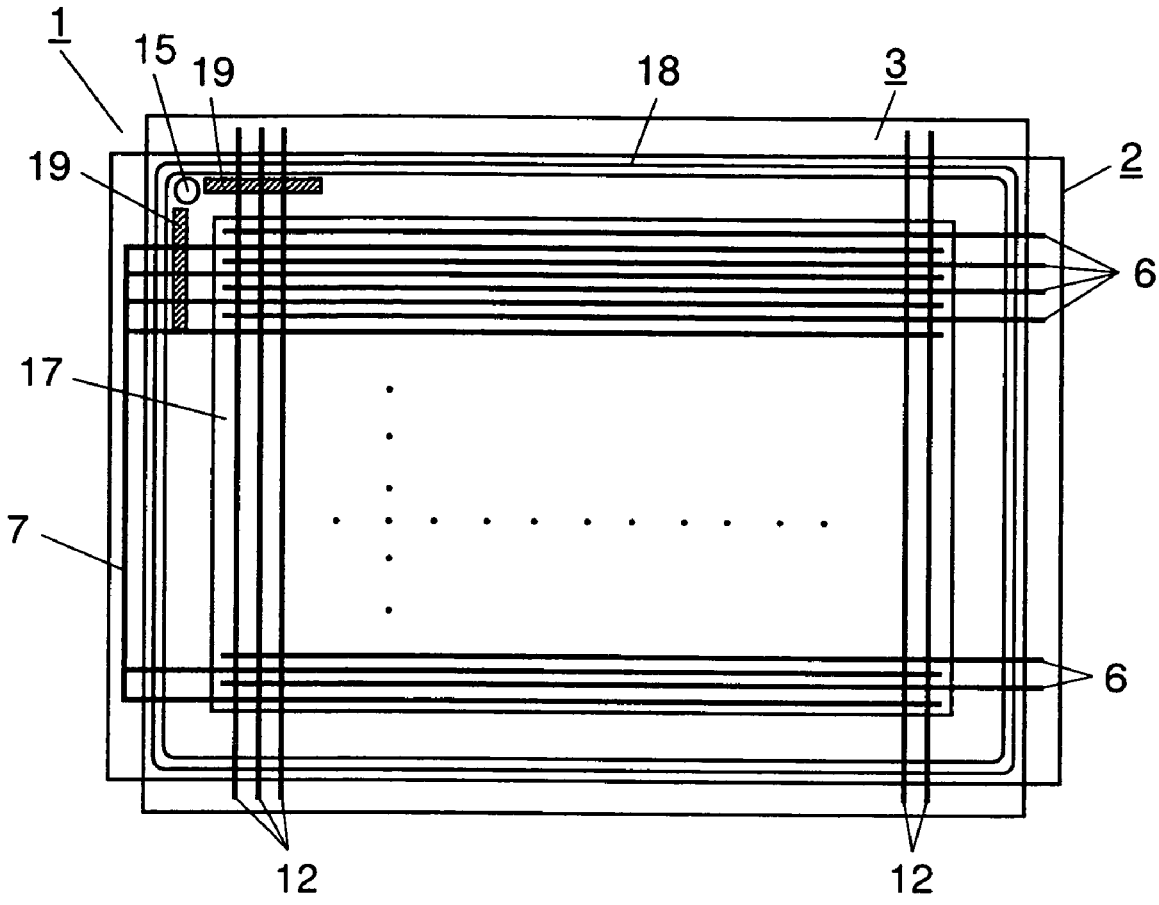
FIG. 1 is a plan view illustrating a schematic structure of a PDP in accordance with a first exemplary embodiment of the present invention.
Figure 2:
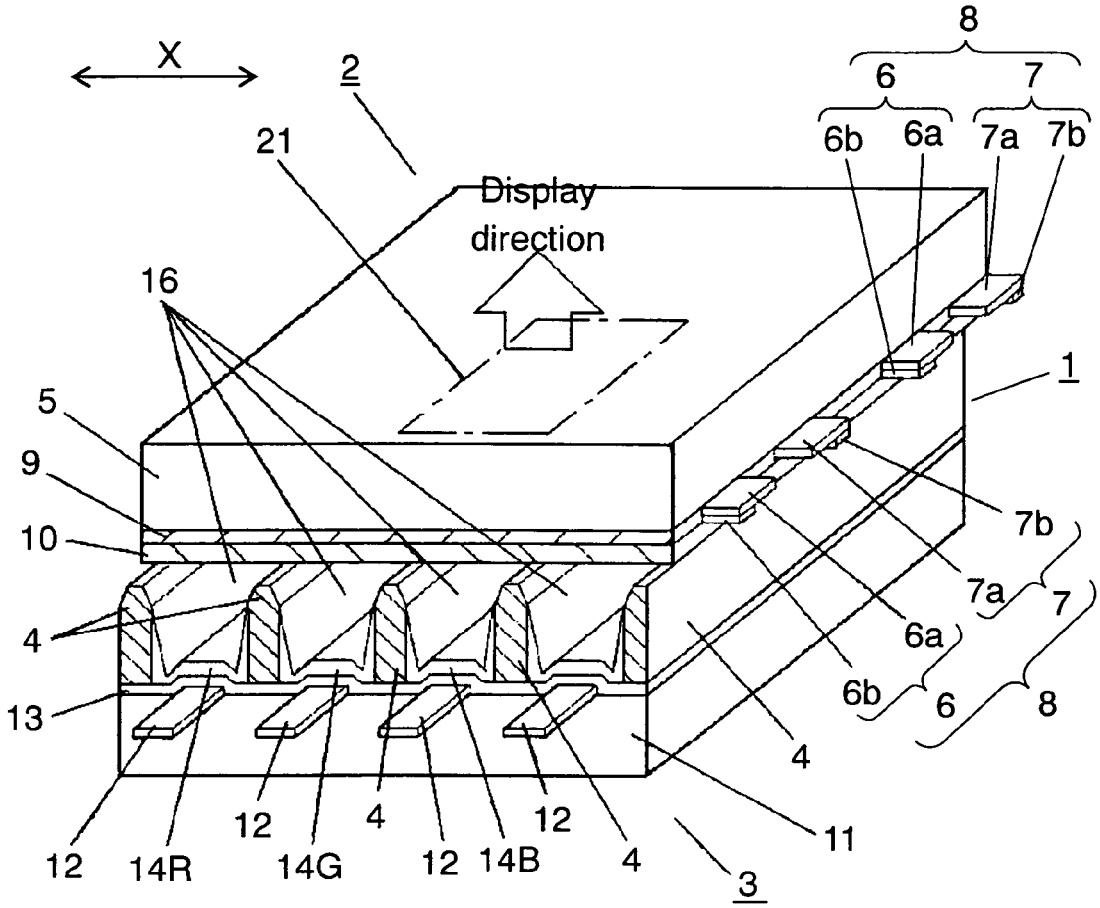
FIG. 2 is a sectional perspective view illustrating a schematic structure of a part of image display area in the PDP in accordance with the first exemplary embodiment of the present invention.
Figure 3:
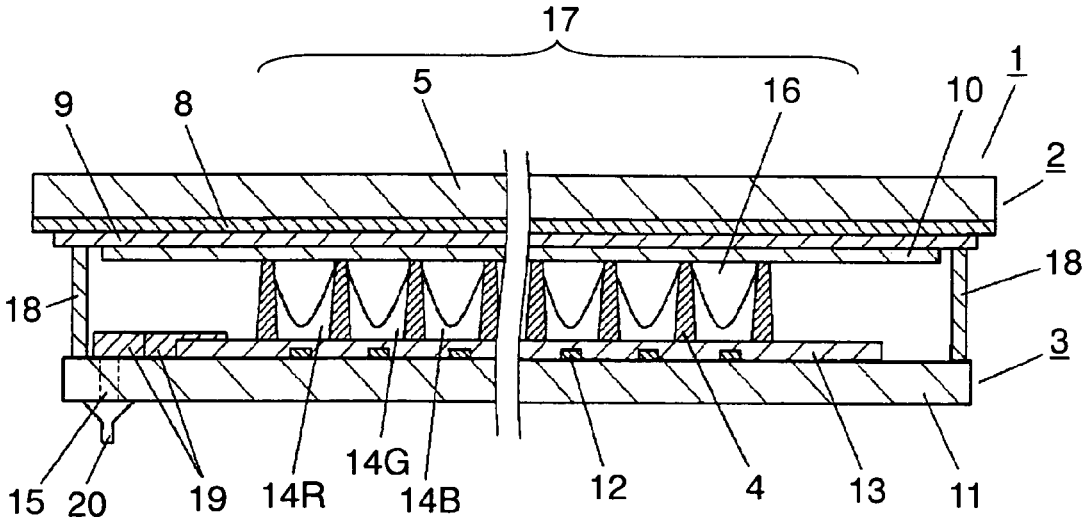
FIG. 3 is a sectional view taken along direction X in FIG. 2.

FIG. 1 is a plan view illustrating a schematic structure of a PDP in a first exemplary embodiment of the present invention. FIG. 2 is a sectional perspective view illustrating a schematic structure of a part of image display area in the PDP in the first exemplary embodiment of the present invention. FIG. 3 is a sectional view illustrating a schematic structure of the PDP in the first exemplary embodiment, taken along direction X in FIG. 2.

PDP 1 is configured by sandwiching partition 4 between a pair of front board 2 and rear board 3. Front board 2 has display electrode 8, including scanning electrode 6 and maintenance electrode 7 formed on one main face of front glass substrate 5, dielectric layer 9 covering display electrode 8, and protective layer 10 made typically of MgO covering dielectric layer 9. Scanning electrode 6 and maintenance electrode 7 are configured by laminating bus electrodes 6*b* and 7*b* onto transparent electrodes 6*a* and 7*a*.

Rear board 3 has data electrode 12 formed on one main face of rear glass substrate 11, dielectric layer 13 covering data electrode 12; partitions 4 formed at positions between data electrodes 12 on dielectric layer 13; red, green and blue phosphor layers 14R, 14G and 14B formed between partitions 4, and exhaust hole 15.

Front board 2 and rear board 3 as configured above are disposed in such a way that display electrode 8 and data electrode 12 cross at right angles and discharge space 16 is formed with partitions 4 in between. Front board 2 and rear board 3 are sealed with sealing material 18 applied to predetermined points on the periphery of front board 2 and/or rear board 3, i.e., out of image display area 17.

Non-evaporating getter 19 is disposed inside PDP 1 near exhaust hole 15 on, for example, rear board 3. Exhaust pipe 20 encloses exhaust hole 15 and is connected to outside rear board 3. Exhaust pipe 20 is used for evacuating inside or injecting discharge gas inside during the manufacture of PDP 1, after which exhaust pipe 20 is sealed to complete PDP 1.

In discharge space 16, at least one of noble gas helium, neon, argon and xenon is injected at a pressure of about 66500 Pa (500 torr). Crossing points of data electrode 12 and display electrode 8, which is scanning electrode 6 and maintenance electrode 7, divided by partition 4 operate as discharge cells 21 which are unit illuminating areas.

More specifically, visible light is generated by applying a periodic voltage to between display electrode 8 and data electrode 12, and between scanning electrode 6 and maintenance electrode 7 of display electrode 8 in discharge cell 21 to be turned on so that electric discharge occurs; and exciting phosphor layers 14R, 14G and 14B by the ultraviolet rays generated by this electric discharge. Images are displayed by combination of turning on and off discharge cells 21 of each color.

Figure 4:
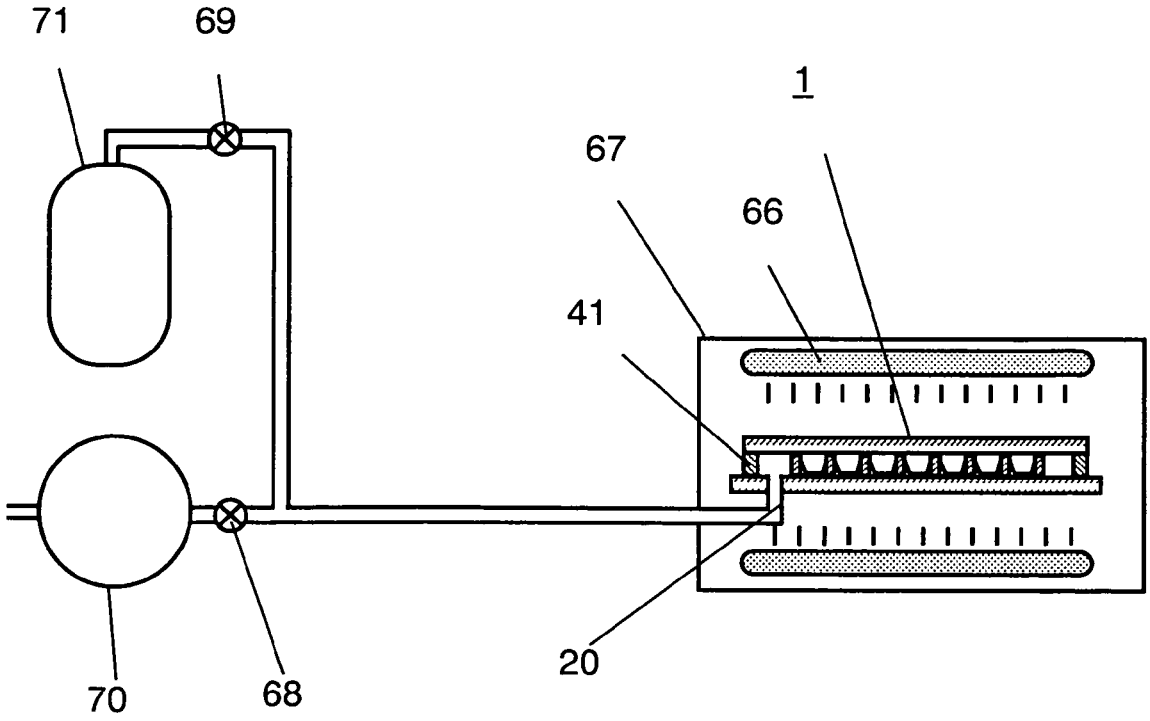
FIG. 4 is a schematic diagram of a structure of a manufacturing device used in an exhaust process and gas injection process of the PDP in accordance with the first exemplary embodiment of the present invention.
Figure 6:
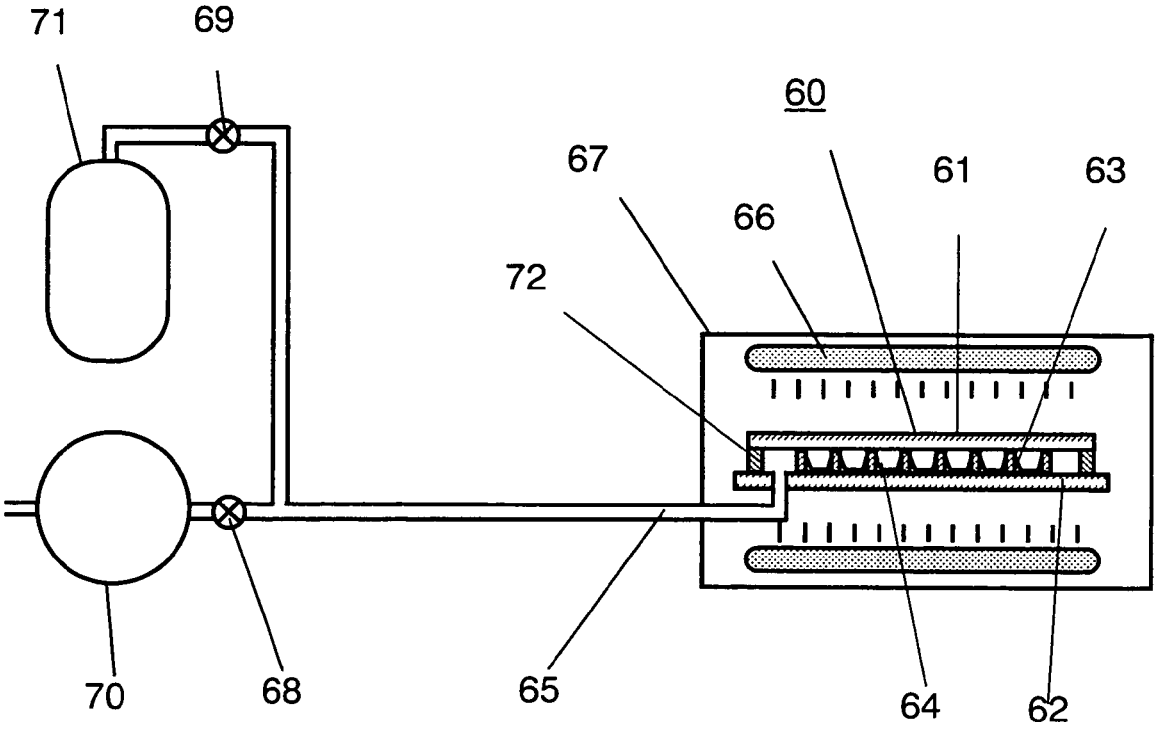
FIG. 6 is a schematic diagram of a structure of manufacturing equipment used in the exhaust process and gas injection process of the PDP in the prior art.

An evacuation process and discharge gas injection process of the PDP above are described next with reference to FIG. 4. The evacuation device and discharge gas injecting device are the same as those in the prior art shown in FIG. 6. While PDP 1 is heated with heater 66, valve 68 is opened to reduce pressure inside PDP 1 through exhaust pipe 20 using vacuum pump 70 to exhaust impurity gases inside PDP 1. Then, valve 68 is closed and valve 69 is opened to inject discharge gas made of noble gas from container 71 to inside PDP 1. Lastly, exhaust pipe 20 is heated and fused, typically using a gas flame, to entirely seal PDP 1 to complete PDP 1 with discharge gas sealed within.

Most of the impurity gases can be exhausted from PDP 1 by evacuating the impurity gases inside PDP 1 by operating vacuum pump 70 while heating PDP 1 with heater 66. However, in the prior art, some impurity gases attach to the inner face of exhaust pipe 20, and thus remain in the exhaust pipe without being completely removed. Accordingly, the remaining impurity gases are swept back inside PDP 1 in the next sealing process. Even a trace of impurity gases remaining in PDP 1 has detrimental effects such as dimming of phosphor luminance.

In particular, it is found that hydrocarbon gas in impurity gases degrades the characteristics of green phosphor 14G and blue phosphor 14B even at low concentrations of about 1/100 to 1/1000 of water vapor and 1/10 to 1/100 of carbon dioxide gas. Its mechanism is that if $Zn_2$ $SiO_4$:Mn is used as green phosphor, gas adsorption by $Zn_2SiO_4$:Mn is high. If $BaMgAl_{10}O_{17}$:Eu is used for blue phosphor, it is affected by the hydrocarbon gases decomposed into hydrogen and carbon by electric discharge energy. Hydrogen encourages reduction and causes oxygen deficiency.

PDP 1 in the exemplary embodiment of the present invention is characterized by the provision of a non-evaporating getter 19 inside PDP 1 near exhaust hole 15.

With this configuration, impurity gases adsorbed and remaining near exhaust hole 15 in the conventional configuration, during evacuation of PDP 1 and injection of discharge gas after sealing front board 2 and rear board 3, are adsorbed to the non-evaporating getter 19 in this exemplary embodiment of the present invention. Impurity gases adsorbed or remaining near exhaust hole 15 can thus be reduced, allowing suppression of erroneous electric discharge and reduced luminance.

It is apparent that non-evaporating getter 19 is disposed away from image display area 17 so as not to disturb image display.

In the first exemplary embodiment of the present invention, getter 19 needs to be disposed inside PDP 1 near exhaust hole 15 before the sealing process. In the sealing process, PDP 1 is heated to the firing temperature of glass frit in the ambient air. Therefore, getter 19 is activated in some cases. If this happens, getter 19 adsorbs ambient air, weakening its ability to adsorb the impurity gases inside PDP 1, which is the primary intention. To prevent this from happening, it is preferable to replace the ambient air with an inactive gas such as argon on and after the step during which the sealing temperature reaches at least the temperature that activates getter 19. It is also preferable to select a material which can emit any air, which has been adsorbed in the sealing process, during the next exhaust process and which can be reactivated to restore the gas adsorption effect.

In the above description, getter 19 is disposed inside PDP 1 near the exhaust hole 15 on rear board 3. However, it is apparent that getter 19 is not limited to occupying this position. Getter 19 can be disposed on front board 2 or on both boards.

In the preferred embodiment, it is preferable to employ zeolite as non-evaporating getter 19 if a primary intention of getter 19 is to remove impurity gases emitted from sealing material 18, taking into account the degree of effect on the display characteristics. Zeolite includes ion-exchange zeolite, lithium ion-exchange mordenite, sodium ion-exchange mordenite, calcium ion-exchange faujasite (type x) and clinoptilolite. Since zeolite is inexpensive, a similar effect is achievable more inexpensively than by the use of the conventional getter.

Second Exemplary Embodiment

Figure 5:
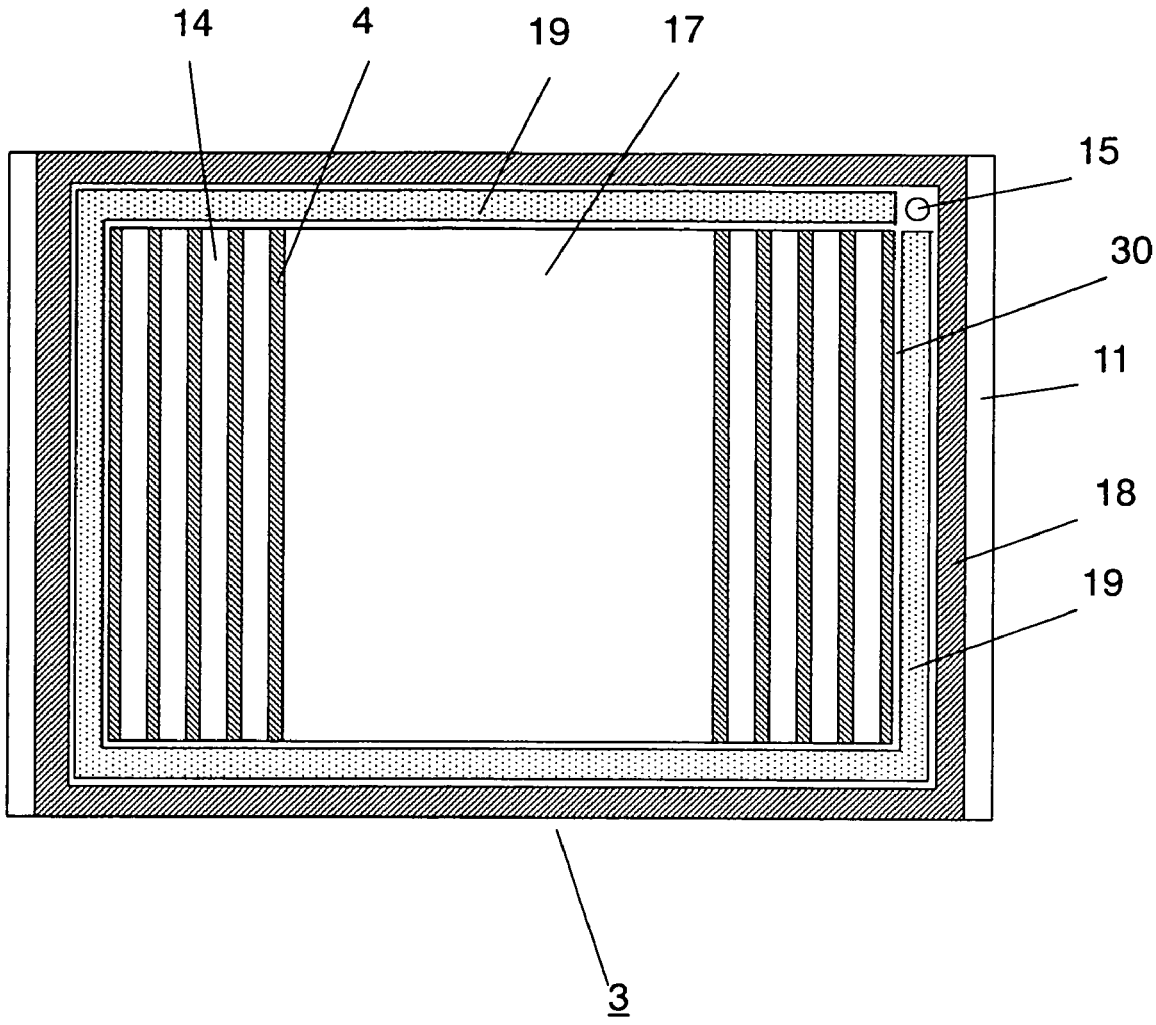
FIG. 5 is a plan view of a rear board of a PDP in accordance with a second exemplary embodiment of the present invention.

FIG. 5 is a plan view of rear board 3 of PDP 1 in a second exemplary embodiment of the present invention. In this exemplary embodiment, zeolite, which acts as non-evaporating getter 19, is applied over the entire periphery of non-image display area 30 between image display area 17 and sealing material 18.

This configuration increases the adsorption area of zeolite, enhancing the effect of removal of impurity gases.

Provision of the non-evaporating getter inside the PDP as described above is selectable, and is easily provided by applying paste containing zeolite to predetermined portions in non-image display rear 30.

INDUSTRIAL APPLICABILITY

The present invention offers a highly reliable PDP with less luminance degradation and better image display quality, making it suitable for display devices such as wall TVs and large monitors.

The invention claimed is:

1. A plasma display panel comprising:

a plurality of members disposed parallel to one another to form a chamber between them, the chamber including an image display region surrounded by a peripheral region, an exhaust hole for evacuating the chamber is formed in a region of one of the plurality of members corresponding to the peripheral region of the chamber; and a non-evaporating getter disposed inside the chamber such that a portion of the non-evaporating getter is disposed in a section of the chamber that is between an edge of the display region and the exhaust hole.

2. The plasma display panel as defined in claim 1, wherein the non-evaporating getter is zeolite.

3. A plasma display panel comprising:

a plurality of members disposed parallel to one another to form a chamber between them, the chamber including an image display region surrounded by a peripheral region, an exhaust hole for evacuating the chamber is formed in a region of one of the plurality of members corresponding to the peripheral region of the chamber; and a non-evaporating getter disposed inside the chamber such that a portion of the non-evaporating getter is disposed in a section of the chamber that is between an edge of the display region and the exhaust hole, the non-evaporating getter selected from the group consisting of;

ion-exchange zeolite, lithium ion-exchange mordenite, sodium ion-exchange mordenite, calcium ion-exchange faujasite and clinoptilolite.

* * * * *